US006623361B1

(12) United States Patent
Parsons

(10) Patent No.: US 6,623,361 B1
(45) **Date of Patent: *Sep. 23, 2003**

(54) FORMED COVER FOR EXPANDABLE BATONS

(75) Inventor: Kevin L. Parsons, Appleton, WI (US)

(73) Assignee: Armament Systems and Procedures, Inc., Appleton, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 553 days.

(21) Appl. No.: 09/122,022

(22) Filed: Jul. 24, 1998

Related U.S. Application Data

(63) Continuation-in-part of application No. 08/716,085, filed on Sep. 19, 1996, now Pat. No. 5,919,093, which is a continuation-in-part of application No. 08/410,764, filed on Mar. 27, 1995, now Pat. No. 5,645,276.

(51) Int. Cl.[7] ..... A63B 67/00
(52) U.S. Cl. ..... 463/47.7

(58) Field of Search ..... 463/47.7; 473/30, 473/568, 549

(56) References Cited

U.S. PATENT DOCUMENTS

| | | | | |
|---|---|---|---|---|
| 748,000 | A | * | 12/1903 | Murnane |
| 1,165,484 | A | * | 12/1915 | Zimmerman |
| 1,685,588 | A | * | 9/1928 | Hemming |
| 3,140,873 | A | * | 7/1964 | Goodwin |
| 5,110,375 | A | * | 5/1992 | Parsons |
| 5,551,323 | A | * | 9/1996 | Beere et al. |
| 5,599,019 | A | * | 2/1997 | Davis |
| 5,816,934 | A | * | 10/1998 | Huang |

* cited by examiner

*Primary Examiner*—William M. Pierce
(74) *Attorney, Agent, or Firm*—Welsh & Katz, Ltd.

(57) ABSTRACT

A cover for an expandable baton handle is injection molded onto the handle to provide an integral, unitary handle cover for the baton handle. The baton handle is further provided with locking rings or grooves at opposite ends. The grooves cooperate with ridges provided on the cover in a mating relationship to prevent the cover from moving relative to the baton handle.

26 Claims, 2 Drawing Sheets

10
12
16
14

21
28
18
14
20

23
22

5
5

10
12
22
18
26
20

10
12
22
18
14
24
20
26

FORMED COVER FOR EXPANDABLE BATONS

RELATED APPLICATIONS

This is a continuation-in-part application of U.S. patent application Ser. No. 08/716,085, filed on Sep. 19, 1996, now U.S. Pat. No. 5,919,093, which is a continuation-in-part application of U.S. patent application Ser. No. 08/410,764, filed on Mar. 27, 1995, now U.S. Pat. No. 5,645,276.

BACKGROUND OF INVENTION

1. Field of Invention

This invention is directed generally to expandable batons for use by law enforcement personnel and is specifically directed to a formed handle cover for such batons.

2. Description of the Prior Art

Expandable batons are well known intermediate force weapons used as a restraint device by law enforcement personnel. Typically, such batons include a plurality of nesting sections which may be whipped and telescoped into the expanded position and locked in place in a single motion. The locking mechanism may include a button lock system as shown in my issued U.S. Pat. No. 5,149,092, or a tapered wedge lock system as shown in my U.S. Pat. No. 5,348,297.

The largest section of the nesting baton typically defines the handle by which the baton is gripped during use. It is desirable that the handle be covered with a high-friction cover in order to permit maximum utilization of the baton while minimizing the risk of the baton slipping out of the grasp of the user. The material for the cover must be capable of withstanding rigorous, repeated use without separating from the baton handle. In the prior art, several different cover styles and designs are available, ranging from a knurled surface applied directly to the baton casing to wrapping or enveloping the baton handle with a Neoprene brand, Hypolon brand or foamed vinyl cover.

The knurled handle increases the friction over a smooth surface, but not to a degree sufficient to achieve the desired functional result. That is, the friction level of the cover is still too low for certain whipping motions, increasing the risk of the baton flying out of the hand during use. Alternatively, too much knurling may eat through clothing or wear the lining of a coat or shirt. However, the knurled handle does meet the requirements of being durable and permanently secured to the baton, thereby minimizing loss of function through wear and tear.

As more exotic materials are utilized for batons, from wound fibers to hardened steel or tungsten/magnesium alloys, the cost of machining a knurled handle becomes almost prohibitive.

More recently, handles are covered with a cylindrical tube cover formed to fit snugly on the periphery of the baton. Specifically, covers have been dip molded onto cores shaped like baton handles. Dip molded covers, however, are time consuming and expensive to manufacture. Further, as a result of the dipping process, the wall of the cover is thicker at its bottom portion than at its top portion. To protect the thinner portion of the cover, a collar is welded into the handle. Such collars, however, are expensive and add to the cost of manufacturing the baton. Also, dip molding is imprecise. Environmental factors such as heat, temperature and humidity have a great effect on the thickness of the covers. Thus, it is not uncommon for dip molded covers to be rejected as being either too thick or too thin.

The covers are bonded to the baton by either glue or other bonding adhesives which are applied directly to the abutting surfaces or through the use of double backed tape or the like. Double backed tape is particularly useful since it allows the best available bonding agent to be applied directly to the cover while at the same time permitting use of the most effective bonding agent to be applied against the surface of the handle.

However, even with the use of double backed tapes, after repeated uses the cover will slip relative to the baton handle. As a result, the front exposed edge of the cover tends to wear and roll back from repeated insertion of the baton into a typical scabbard used for stowing the baton handle on the person of the law enforcement personnel. This is particularly true if the baton includes an integral taper, making a tubular cover loose in specific regions of the handle. Also, because installing the cover onto the handle must be done by hand, it requires a great deal of time, which adds to the expense of the manufacturing process.

In addition, in practice the baton is extended by a whipping action that causes the telescoping sections of the baton to lock in an extended position. After use, the extended baton must be retracted. To retract the baton, the tip of the baton typically is struck against a hard surface and the telescoping sections collapse into a nesting position within the baton handle. The collapsing action often requires a significant force to release the extended baton from its locked extended position. The repeated action of extending and retracting the baton may cause the cover to slip relative to the baton. During the whipping action used to extend the baton, there exists a potential for the cover to slip relative to the handle. Similarly, during the collapsing of the baton, the striking action results in a downward force being applied to the cover, the force having a tendency to cause the cover to slip relative to the handle. The cover slipping relative to the handle can bring about undesirable results. For example, when the cover becomes loose relative to the baton handle, it is possible that the handle may actually slip out of the cover during the extending action. Thus, there is a need to provide an extendable baton having a cover that will not slip relative to the baton handle during use.

Rigid annular collars have helped alleviate this problem, but such collars increase both the cost of material and the cost of assembly of the baton. In addition, it is possible that such collars will separate from the baton, further increasing the possibility of reducing the functional life of the device.

Because of the critical applications in which such batons are employed, it is important that the handle cover be secure and maintained at optimum function throughout its life. Therefore, there remains a need for a durable friction cover for expandable batons designed for law enforcement use.

SUMMARY OF THE INVENTION

The subject invention is specifically directed to a durable friction cover for an expandable baton for law enforcement use. In a preferred embodiment of the invention, a cover is formed on and bonded directly to the handle of the expandable baton in an injection molding operation. This eliminates loose outer ends and resultant rolling or tearing of the cover through repeated use, without the need of a collar to protect the front exposed edge of the cover. The resulting cover is durable, is permanently bonded to the baton and is inexpensive to manufacture, the forming and bonding steps being accomplished in a single overmolding process.

In the preferred embodiment, the baton handle is placed in a mold cavity and the cover material is injection molded directly onto the handle. In an alternate preferred embodiment, the outer surface of the baton handle is provided with circumferential locking rings or grooves. The material injection molded about the baton handle fills the locking grooves during the injection molding process such that there is a mating relationship between the grooves of the baton handle and the resulting injection molded cover. In particular, ridges are formed about the inside surface of the cover to mate with the grooves of the handle. The ridges of the cover and the grooves of the handle cooperate to retain the cover in place after the cover is injection molded onto the baton handle. The grooves are designed to prevent the cover from slipping or moving relative to the baton handle during the extending or retracting actions. Furthermore, because the grooves are deeper than the "stretch" of the cover material, the ridges of the cover are prevented from stretching out of cooperation with the grooves during the extension or retraction of the expandable baton. In this manner, the cover is maintained in a fixed position with respect to the baton handle, thereby preventing the problems associated with slippage of the cover relative to the baton handle. Furthermore, not only does injection molding permanently bond the material to the baton handle, but the mold cavity defines the custom shape of the cover, permitting an integral, continuous, wrap around construction, greatly enhancing both the appearance and the durability of the cover. In addition, the molding process eliminates several steps of manufacture, reducing the overall costs of the product. Costs are further reduced because the molding process ensures the precision of the covers, thereby reducing waste resulting from imprecise covers.

Overmolding in this manner also permits a broader selection of covers to be utilized without changing the manufacturing process. Various pigments may be added to the stock material to permit handles of different, selected colors. The composition of the stock material and the pressure and cure time of the molding process may be adjusted to provide handles ranging from a hard, rigid material to a soft, compressible or resilient cover. The outer surface of the cover may be controlled by the mold cavity surface.

The molded and formed cover of the subject invention greatly improves the function and appearance of the handle while at the same time reducing the costs of the finished baton.

It is, therefore, an object and feature of the subject invention to provide a formed cover for the handle of an expandable baton for law enforcement use.

It is an additional object and feature of the subject invention to provide a cover that is permanently bonded to the baton handle.

It is a further object and feature of the subject invention to provide a cover and a baton handle wherein circumferential locking rings or grooves are provided on the baton handle to mate with ridges provided on the cover to prevent relative movement between the cover and baton handle during operation.

It is another object and feature of the subject invention to provide a cover having outer ends which do not come loose or roll back as a result of repeated insertions of the baton into a standard baton scabbard on the person of the law enforcement personnel for stowing the baton.

It is yet another object and feature of the subject invention to provide a baton having a variety of color covers and texture covers using a single manufacturing process.

Other objects and features of the invention will be readily apparent from the following drawings and detailed description of the preferred embodiments.

DETAILED DESCRIPTION OF THE PREFERRED EMBODIMENTS

Figures 1, 2, 3, 4, 5, 6:
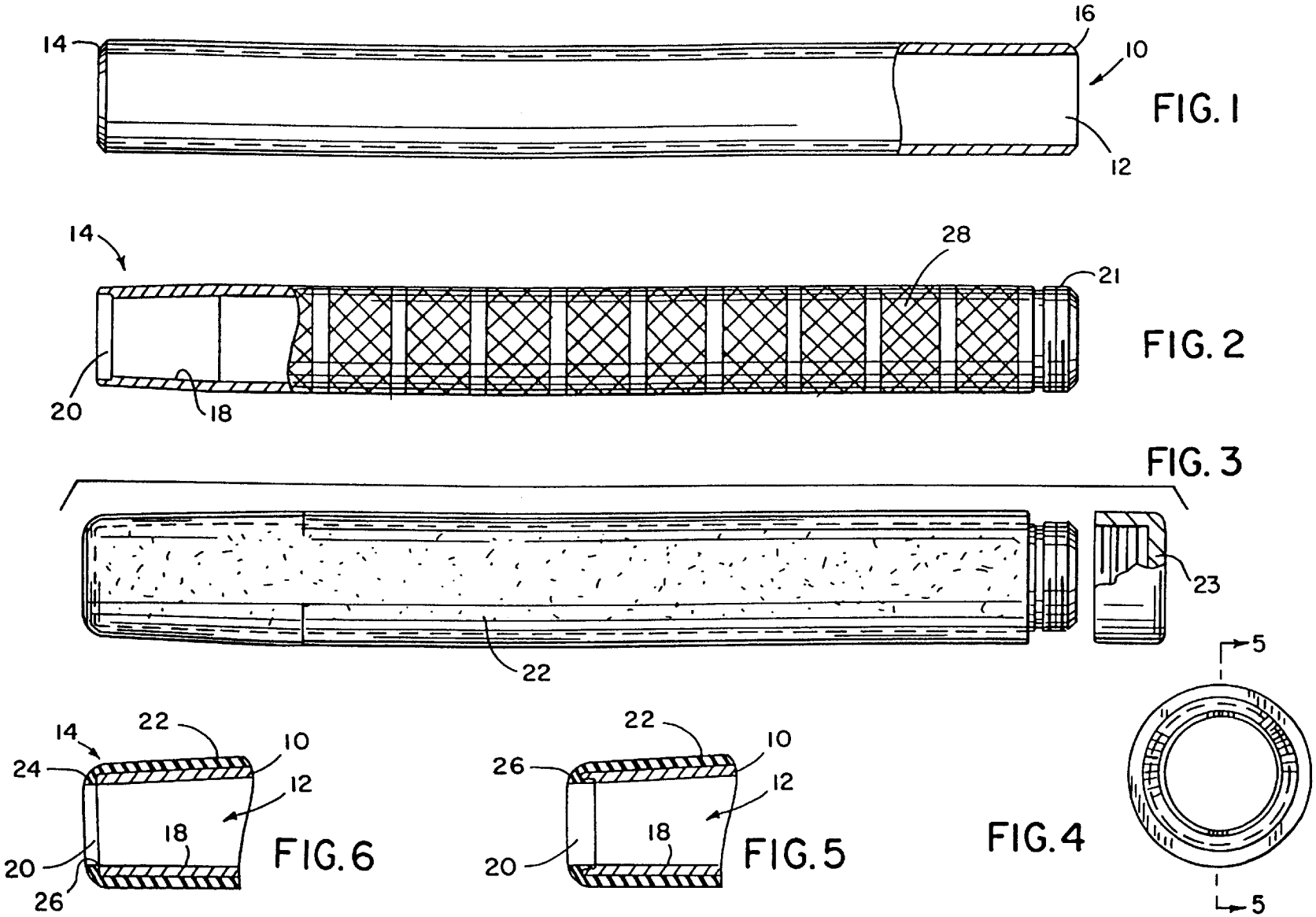
FIG. 1 is a longitudinal view of a standard handle of an expandable baton, prior to machining.
FIG. 2 is a longitudinal view of the baton handle of FIG. 1, after machining and swaging to form the finished handle.
FIG. 3 is a longitudinal view of the handle of FIG. 2 with the formed, molded cover, handle and end cap assembly.
FIG. 4 is an end view of the handle of FIG. 3.
FIG. 5 is a partial sectional view taken along line 5—5 of FIG. 4 to show the detail of the molded cover with a lip molded adjacent the end of the cover.
FIG. 6 is a perspective, partial sectional view taken along line 5—5 of FIG. 4 to show the detail of the molded cover without a lip molded adjacent the end of the cover.

A typical tube blank for defining the handle of an expandable baton is shown in FIG. 1. The handle shown is of the type utilized in the friction lock baton shown and described in my U.S. Pat. No. 5,348,297, incorporated by reference herein. The baton handle 10 includes a hollow, cylindrical tube 12 that is adapted to receive and nest additional sections of the baton. In a preferred embodiment, the handle is 7.187 inches in length with an external diameter of 0.875 inches, and is made of 14 gauge steel tubing. The ends 14 and 16 are chamfered typically at 45 degrees. As shown in FIG. 2, one end 14 of the tube is swedged approximately 0.875 inches to form a reducing interior taper 18. This interior taper forms the handle of the wedge lock system as described in my aforementioned U.S. Pat. No. 5,348,297. The outermost end 20 is bored to provide an enlarged annular recess for receiving and seating the periphery of the button end of the baton, also as shown in my aforementioned U.S. Pat. No. 5,149,092. The opposite end 16 of the tube is externally threaded at 21 for receiving an end cap 23 (FIG. 3) in order to hold the assembled nested baton sections in place.

It will be noted that the machined area 20 and swedged area 18 present unique problems for a cover to be placed over the tube in order to provide a good friction cover. Specifically, tubular material will be somewhat loose at the swedged area in relationship to the remainder of the tube. Also, the exposed metal in the bore area 20 will generate an undesirable "clicking" sound when the button tip seats in the annular recess. In the past, this has been resolved by placing an annular ring or collar over the end 14, increasing both material and assembly costs.

The reduced diameter of the swedged section 18 can only be dealt with by utilizing a custom form cover instead of a standard straight cylindrical tube cover, greatly increasing the cost of the cover. In the prior art, a straight cylindrical tubular cover was generally utilized with a bonding agent between the cover and the steel tube. While generally suitable, the end of the cover adjacent outer end 14 of the tube would tend to roll up, particularly since the cover was slightly oversize due to the swedged area 18.

In a preferred embodiment, the machined and swedged handle is placed in a mold cavity and the cover 22 (see FIGS. 3, 4, 5) is injection molded around the handle. This permits the cover 22 to be tightly and permanently bonded not only to the straight section of the tube 12, but also to the swedged, tapered section 18, as well. As is shown in FIG. 5, the outer end 24 of the cover may be formed to enclose the exposed outer end 14 of the handle to serve as a cushion for the baton tip. Furthermore, as is shown in FIG. 5, the outer end 24 of the cover may continue into the annular recess 20, as shown at 26, thereby eliminating the necessity of an end cap. The molded cover 22 provides an integral cover form fitted to the contours of the handle, covering all exposed areas where metal-to-metal contact is not desired. In addition, the integral cover eliminates any roll up tendencies previously due to loose fitting areas around the swedged portion.

The specific finish texture of the outer wall of the cover 22 is controlled by the surface of the mold cavity. Hardness of the cover is controlled by mold pressure, cure time and composition of the material. The cover color of the mold may be altered by providing pigmentation in the material composition which is injected into the mold.

In a preferred embodiment, and as shown in FIG. 2, the outer surface of tube may be knurled or otherwise roughened as at 28 to provide a better gripping or bonding surface for the cover 22. While the entire length of the tube 12 is knurled in the embodiment shown, good enhanced bonding may be achieved with knurling only at or near the threaded end 21 of the tube. This is because the wrapping of the cover 22 at 26 provides a good bond at the opposite end.

Figure 7:
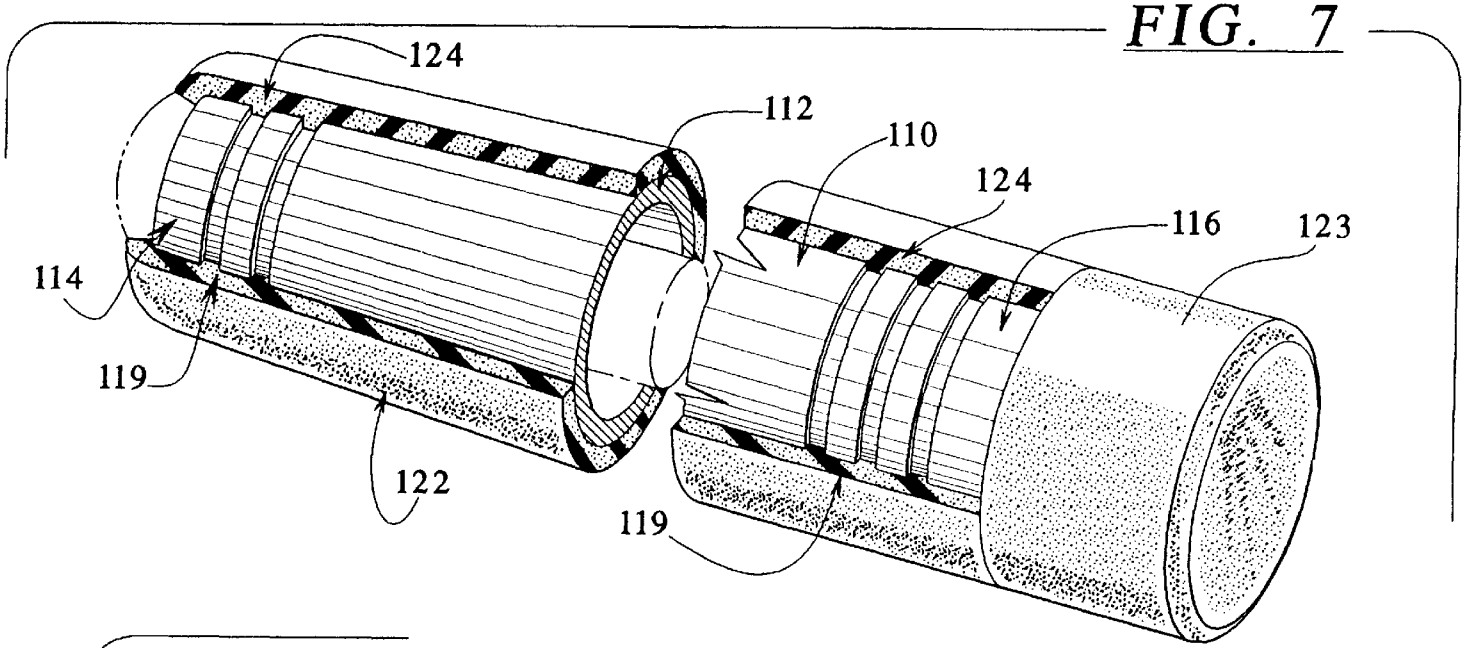
FIG. 7 is a perspective view of a baton handle having circumferential locking rings or grooves, a cover having ridges in mating relationship with the grooves, and an end cap assembly.
Figure 8:
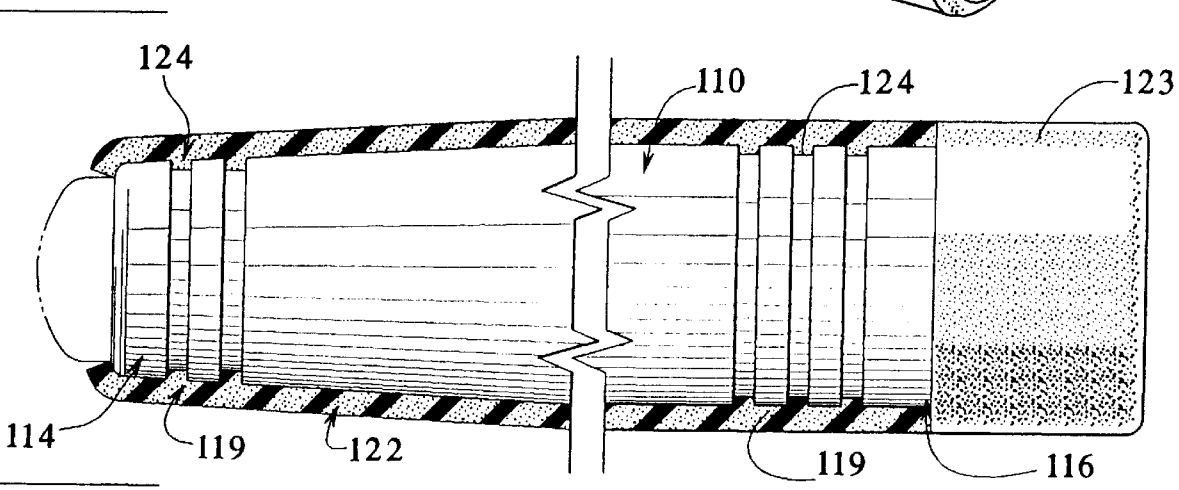
FIG. 8 is a longitudinal, partial sectional view of the embodiment of FIG. 7.

An alternate preferred embodiment of the present invention is shown in FIGS. 7 and 8. In this embodiment, baton handle 110 includes a hollow, cylindrical tube 112 having ends 114, 116. The tube 112 is substantially identical to tube 12 of the embodiment of FIGS. 1–5. Alternately, the tube 112 could have a taperless exterior. The tube 112 in FIG. 7 differs from tube 12 in FIG. 1 in that tube 112 is provided with a plurality of circumferential locking rings or grooves 119 adjacent to each end 114, 116. The grooves 119 are formed in the tube 112 by machining or any such suitable method. As in the embodiment of FIGS. 1–5, one end 116 of tube 112 is externally threaded (not shown) for receiving an end cap 123 in order to hold the assembled nested baton sections in place.

The baton handle 110 of FIGS. 7 and 8 is further provided with a cover 122. After the grooves are machined onto tube 112, a cover 122 is injection molded directly onto the handle 110. As a result, the molded cover 122 is attached to the tube 112 and provides an integral cover form fitted to the contours of the handle 110. Specifically, ridges 124 are formed about the inside surface of the cover 122 to mate with the grooves 119 of the handle 110. The mating relationship between the circumferential grooves 119 and the ridges 124 functions to prevent the cover 122 from slipping or moving relative to the baton handle during the extending or retracting actions. Furthermore, because the grooves 119 are deeper than the "stretch" of the cover material, the ridges 124 of the cover 122 are prevented from stretching out of cooperation with the grooves 119 during the extension or retraction of the expandable baton.

As can be appreciated from FIGS. 7 and 8, the grooves 119 of tube 112 provide a better gripping or bonding surface for the cover 122 relative to the baton handle 110. It should be understood that the grooves 119 provided on the tube 112 are not limited to the arrangement shown in FIGS. 7 and 8. Additional grooves can be provided at either end of the tube. Similarly, a fewer number of grooves at either end of the tube can be provided. It is possible to have grooves only at the end 116 of tube 112. Also, the number of grooves at each end of the tube need not be equal. Further, the dimensions of the grooves need not be identical. Nonetheless, the particular arrangement of grooves shown in FIGS. 7 and 8 has been shown to be particularly effective in preventing relative movement between the cover and the baton handle.

In a preferred embodiment, the grooves as shown in FIGS. 7 and 8 are equally spaced and have a width in the range of 0.05–0.50 inches, preferably 0.080 inches, and a depth in the range of 0.02–0.05 inches, preferably 0.030 inches. Furthermore, the handle cover 122 is made of an elastomer having the trade name Santoprene available from Advanced Elastomer Systems. With this combination, the elastomeric cover 122 will not stretch beyond the grooves 119 of the baton handle 110 during extension or retraction of the expandable baton in operation. Thus, the cover 122 is permanently fixed to the handle 110 of the baton.

The interaction between grooves 119 and ridges 124 in combination with the cover 122 being injection molded directly onto the tube 112 assist in keeping the cover in place. The cover 122 is prevented from moving relative to the tube 112 whether the baton is being whipped into its extended position or placed into its collapsed position. Thus, the undesirable wearing and rolling back of the front edge of the cover is avoided. In another preferred embodiment, a single groove having a width of between 0.25 and 0.50 inches may be provided on the handle near the end opposite the tip.

While certain features and embodiments of the invention have been described herein, it will be readily understood that the invention encompasses all modifications and enhancements within the scope and spirit of the following claims.

What is claimed is:

1. A handle in combination with an expandable baton, the handle comprising:

a hollow cylindrical tube having a plurality of square-cut grooves about a portion thereof, each groove having a groove diameter less than an outer diameter of the tube adjacent said groove; and a cover attached to the tube having an internal diameter approximately equal to the outer diameter of the tube, wherein the cover conforms to an outer surface of the tube;

whereby each groove of the tube cooperates with a ridge located on the internal diameter of the cover and having a diameter approximately equal to the groove diameter, and where the cover is constructed of a material such that the diameter of the ridge cannot stretch or expand to a size of the outer diameter of the tube thereby preventing the cover from moving relative to the tube.

2. The handle of claim 1 wherein the groove diameter is 0.04 to 0.10 inches less than the outer diameter of the tube.

3. The handle of claim 1 wherein the cover is injection molded directly onto the tube.

4. The handle of claim 1 further provided with an end cap at one end of the tube.

5. The handle of claim 2 wherein the groove diameter is approximately 0.06 inches less than the outer diameter of the tube.

6. The handle of claim 1 wherein the tube has a straight section and a tapered section.

7. A method of making a handle for a baton comprising the steps of:

a) providing a hollow cylindrical tube having an outer diameter;

b) machining a plurality of square-cut grooves circumferentially about a portion of the tube, each groove having a groove diameter less than the outer diameter of the tube adjacent said groove; and c) injection molding a cover directly onto the tube, wherein a plurality of ridges are formed in said cover in a mating relationship with said plurality of grooves, said ridges having a diameter approximately equal to the corresponding groove diameter, and wherein said cover is constructed of a material such that the diameter of the ridge cannot stretch or expand to a size of the outer diameter of the tube, thereby preventing the cover from moving relative to the tube.

8. The method of claim 7 wherein the machining step further comprises machining the grooves at one end of the tube.

9. The method of claim 7 wherein the machining step further comprises machining the grooves at opposite ends of the tube.

10. The method of claim 7 wherein the injection molding step further comprises providing the cover in Santoprene.

11. The handle of claim 1 having two or more grooves at a first end of said tube.

12. The handle of claim 11 wherein the grooves at the first end of the tube have approximately the same width.

13. The handle of claim 11 further having at least one groove at a second end of said tube.

14. The handle of claim 13 having at least two grooves at the second end of said tube.

15. The handle of claim 14 wherein a spacing between the grooves at the first end of the tube is approximately equal.

16. The handle of claim 1 wherein the groove has a width of 0.05 to 0.50 inches.

17. The handle of claim 16 wherein the groove has a width of approximately 0.08 inches.

18. The handle of claim 12 wherein the grooves at the first end of the tube have a width of 0.05 to 0.50 inches.

19. The handle of claim 18 wherein the grooves at the first end of the tube have a width of approximately 0.08 inches.

20. The handle of claim 14 wherein the grooves at the second end of the tube have a width of between 0.05 and 0.50 inches.

21. The handle of claim 20 wherein the grooves at the second end of the tube have a width of approximately 0.08 inches.

22. The handle claim 18 wherein the groove diameter of the grooves is 0.04 to 0.10 inches less than the outer diameter of the tube.

23. The handle claim 20 wherein the groove diameter of the grooves is 0.04 to 0.10 inches less than the outer diameter of the tube.

24. The handle of claim 1 wherein the cover is comprised of Santoprene.

25. The handle of claim 16 wherein the grooves have a constant width throughout a depth of the grooves.

26. The handle of claim 20 wherein the grooves have a constant width throughout a depth of the grooves.

* * * * *